US005142260A

United States Patent [19]

House

[11] Patent Number: 5,142,260

[45] Date of Patent: Aug. 25, 1992

[54] TRANSDUCER MOTOR ASSEMBLY

[75] Inventor: William N. House, Bloomington, Ind.

[73] Assignee: Harman International Industries, Incorporated, Northridge, Calif.

[21] Appl. No.: 666,792

[22] Filed: Mar. 8, 1991

[51] Int. Cl.[5] ..... H01F 7/08; H01F 7/02; H04R 25/00

[52] U.S. Cl. ..... 335/222; 335/306; 381/199

[58] Field of Search ..... 335/210, 302, 304, 306, 335/222; 381/192, 199, 201; 315/5.35

[56] References Cited

U.S. PATENT DOCUMENTS

| | | | |
|---|---|---|---|
| 2,895,092 | 7/1959 | Cluwen . | |
| 3,067,366 | 12/1962 | Hofman . | |
| 3,127,544 | 3/1964 | Blume . | |
| 3,168,686 | 2/1965 | King . | |
| 3,737,822 | 6/1973 | Buus et al. | 335/304 |
| 4,117,431 | 9/1978 | Eicher . | |
| 4,471,173 | 9/1984 | Winey | 179/115 |
| 4,578,663 | 3/1986 | Sanders | 335/306 |
| 4,628,154 | 12/1986 | Kort | 381/189 |
| 4,717,876 | 1/1988 | Masi et al. | 335/306 |
| 4,731,598 | 3/1988 | Clarke | 335/306 |
| 4,869,811 | 9/1989 | Wolanski | 335/304 |

FOREIGN PATENT DOCUMENTS

| | | |
|---|---|---|
| 713205 | 7/1965 | Canada . |
| 423197 | 4/1974 | U.S.S.R. . |
| 964824 | 7/1964 | United Kingdom . |

*Primary Examiner*—Leo P. Picard
*Assistant Examiner*—Ramon Barrera
*Attorney, Agent, or Firm*—Barnes & Thornburg

[57] ABSTRACT

A returnless coil motor assembly comprising a voice coil, first and second magnets, the poles of the first and second magnets providing aligned, opposing lines of force in first and second opposite directions, a first spacer having a first face adjacent a pole of the first magnet and a second opposite face, a second spacer having a first face adjacent the like pole of the second magnet and a second opposite face, a third magnet oriented between the second faces of the first and second spacers, and the voice coil mounted in close proximity to the third magnet, the third magnet providing lines of force extending in a third direction generally transverse to both the first and second directions, and the voice coil having a direction of motion extending generally perpendicular to the third direction.

6 Claims, 4 Drawing Sheets

TRANSDUCER MOTOR ASSEMBLY

This invention relates to transducer motor assemblies and particularly to a returnless transducer motor assembly construction. The invention is disclosed in the context of a moving coil loudspeaker motor assembly. However, it is believed to be useful in other applications as well.

Various types of transducer motor assemblies are known. These are, for example, the assemblies illustrated in described U.S. Pat. Nos.: 2,895,092; 3,067,366; 3,127,544; 3,168,686; 4,117,431; 4,471,173; 4,578,663; 4,628,154; and 4,731,598; Canadian Patent 713,205; British Patent Specification 964,824; and, Soviet Union patent application document 423,197. While this listing is a listing of what applicant presently believes is the most pertinent prior art, no representation is intended hereby, nor should such a representation be inferred, that an exhaustive search of all pertinent prior art has been conducted, or that no more pertinent prior art exists.

According to the invention, a transducer motor assembly comprises first and second magnets, the poles of which provide aligned, opposing lines of force in first and second opposite directions, a first spacer having a first face adjacent a pole of the first magnet and a second opposite face, a second spacer having a first face adjacent the like pole of the second magnet and a second opposite face, and a third magnet oriented between the second faces of the first and second spacers. The third magnet provides lines of force extending in a third direction generally transverse to both the first and second directions.

Illustratively, the first, second and third magnets are generally cylindrical in configuration. Further illustratively, the first, second and third magnets are generally right circular cylindrical in configuration, defining a transducer motor assembly axis about which each of the first, second and third magnets is generally symmetrical.

Additionally, illustratively, the transducer motor assembly comprises a returnless voice coil motor assembly. The apparatus further comprises means for mounting a voice coil in close proximity to the third magnet, the voice coil extending generally perpendicular to the third direction.

According to illustrative embodiments, the means for mounting the voice coil in close proximity to the third magnet mounts the voice coil radially outward from the third magnet.

According to an illustrative embodiment, the means for mounting the voice coil in close proximity to the third magnet mounts the voice coil radially inward from the third magnet.

The invention can best be understood by referring to the following description and accompanying drawings which illustrate the invention. In the drawings.

Figure 1:
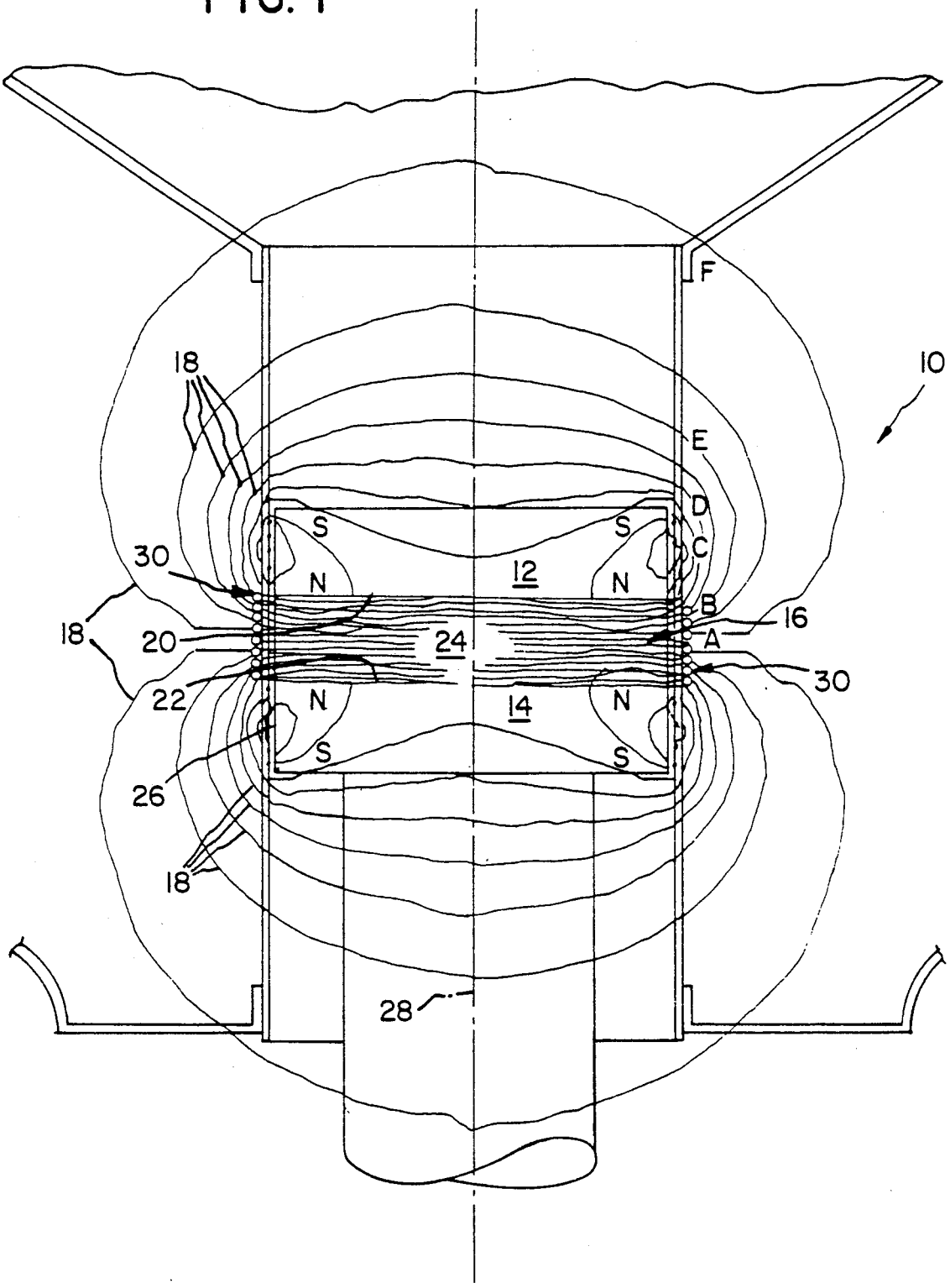
FIG. 1 illustrates a fragmentary axial sectional view through a prior art permanent magnet motor assembly.

As illustrated in FIG. 1, a prior art returnless magnetic circuit structure 10 consists of two axially aligned magnetic disks 12, 14, which are axially polarized and oriented so their resultant flux fields oppose one another. Typically, a spacer 16 of either ferrous or nonferrous material is sandwiched between the magnets 12, 14 to help control the magnetic field characteristics. As a result of the opposing axial alignment, the magnetic flux lines 18 emanating from the magnetic poles 20, 22 that face each other are focused and directed radially outward from the region 24 between the magnets 12, 14.

This prior art structure serves two functions. The first is to increase the number of flux lines per unit cross sectional area in the region adjacent to the structure 10's radially outer surface 26. The second function is to direct the flux lines 18 on paths essentially perpendicular to the axis 28 of the structure. This yields a greater resultant vector force on a current carrying conductor 30 which is immersed in the flux field. The force F is governed by the equation $F = ilxB$, where B is the vector flux density, l is the vector length of conductor in the direction of current flow, i is the magnitude of the current through the conductor 30, and x indicates the vector cross product and relates to the magnitude of the angle between the directions of the flux lines and current flow in the conductor 30. Assuming direct current flow in the conductor 30 and the direction for conductor 30 motion just outside and parallel to the structure's outer surface 26, as indicated by arrows 32, the resultant vector force F is parallel to the structure's axis 28.

Ideally, all flux lines 18 emanating from the structure 10 would be in directions perpendicular to the structure's axis 28 to maximize the force on the conductor 30 throughout its axial length. However, the flux lines 18 must emanate from one portion of the structure 10 and return to another portion, which dictates the flux lines 18 illustrated in FIG. 1. Perpendicular flux lines 18 do, however, occur in the center of the structure 10 between the magnets 12, 14, as illustrated in region A, in FIG. 1. In region A, flux lines 18 of equal magnitude and opposite direction produce a resultant field vector with an angle of 0 degrees. As the distance from the center A of the structure increases along its axis 28 in either direction, the flux line angle (the angle between the flux line 18 and a line perpendicular to the structure 10's axis 28) also increases. See region B, FIG. 1. The interacting fields in this region produce resultant field vectors whose magnitudes and directions are more directly related to their proximity to one or the other of the opposing magnets 12, 14. A point C is reached near the center of each magnet 12, 14 where the flux lines 18 are essentially parallel with the structure 10's axis 28. That is, the flux line angle is substantially equal to 90°. As the distance increases further in region D of FIG. 1, the flux line angle continues to increase beyond 90° and the vector is now increasing in the opposite direction to the flux lines 18 emanating from the center A of the structure 10.

If a current carrying conductor 30 moves in either of the structure 10's axial directions from the structure 10's center in region A to the magnet 12, 14's center in region C, the instantaneous force on the conductor 30, in the direction parallel to the axis 28, decreases as a function of the angle to zero. This assumes the flux density is constant along the axial length. Beyond region C, the force on the conductor 30 begins to increase in region D, but in the opposite direction as the flux lines 18 return toward the magnets 12, 14. The force continues to increase in region E as the distance from point A increases to the outer edges of the magnets 12, 14. Beyond this, the force diminishes toward point F according to the leakage characteristics of the structure 10.

Given the case of a current carrying conductor in the form of a solenoid with a length that spans the entire axial length of the returnless structure 10, and which is allowed to move freely in the axial direction, the resultant vector force on the conductor would approach zero. This is due to the conductor simultaneously cutting flux lines 18 of opposite polarity. Any residual force present would result from asymmetrical field leakage. A very different result occurs with a solenoid 30 whose length is approximately equal to the thickness of the spacer 24 separating the two magnets 12, 14. If the solenoid 30 is free to move axially and is positioned at the center A of the structure 10 and current is passed through the solenoid 30, a force results which causes the solenoid 30 to move axially in one direction until the force exerted on it by the interaction of its current with flux lines 18 of the opposite polarity causes the coil 30 to stop or change directions. It will be appreciated, therefore, that the range of linear motion of the conductor 30 in the axial directions is limited by the physical constraints of the structure 10.

This phenomenon, sometimes called field reversal, is one of the restrictions encountered with returnless path structures, such as structure 10 in FIG. 1. Of the total length of the magnet motor structure 10, approximately 30–50% of the length of each magnet 12, 14 provides an opposing force to the coil 30 and another 20% produces little contribution to the force on the coil 30 due to the small values of F. This means the useful range for controlled linear motion is the thickness of the spacer 24 between the magnets 12, 14 plus approximately 30% of each magnet 12, 14's axial length. Thus, in a prior art assembly, such as the one illustrated in FIG. 1, linear coil 30 motion will generally occur only within a relatively small portion of the axial length.

For a given magnet 12, 14 size and material, the flux density is a function of the spacer 24 thickness sandwiched between the opposing magnets 12, 14. The smaller the spacer 24 thickness, the greater the magnetic field. Conversely, the larger the spacer thickness, the greater the range of linear motion. Typically, the thickness is on the order of 0.05–0.200 inch (1.3–5 mm). The thickness of the magnets 12, 14 also have practical ranges of values to maintain an efficient design in terms of energy gained per unit length of the structure 10. A typical thickness for a rare earth magnet 12, 14 is from 0.100–0.300 inch (2.5–7.6 mm).

Using minimum and maximum thickness components 12, 14, 28 as described provides structures 10 which are in the range of 0.250–0.800 inch (6.4–20 mm) long. Given the range of motion described above and the minimum and maximum structure 10 lengths, a coil 30 in a typical transducer motor structure 10 may have an excursion of 0.110–0.380 inch (2.8–9.7 mm). This does not include the length of the coil 30 which could account for as much as 50% of the remaining length of a transducer motor structure 10, depending on the conductor 30 length needed to achieve a required force or conductor 30 resistance. Thus, the useful range of motion along the axis 28 of a prior art returnless path transducer motor structure 10 is typically restricted to a range less than 0.400 inch (10.2 mm) long. In many applications, such as a loudspeaker motor structure, this range is not sufficient and it would be useful to increase it.

This invention provides the means to improve the magnitude, operating range and linearity of the flux field emanating from a returnless magnetic motor structure using opposing magnets. This can be accomplished by sandwiching one or more additional magnets and spacers between the opposing magnets of the prior art assemblies. The radial magnet's(s') outer pole(s) has (have) the same polarity as the prior art's opposing magnets' facing opposing poles, as illustrated FIGS. 2–4. With this configuration, flux lines emanating from the radial magnet(s) are opposed by the fields of the axial magnets and directed outward on a path perpendicular to the structure's axis. The radial magnet's(s') flux lines travel from the outer pole(s) outward and around to the opposite polarity poles of the axial magnets. This increases the total flux lines provided by the structure. Given the additional axial length afforded by the radial magnet(s) and spacers, a flux density approximately equivalent to the prior art assembly's is maintained over a greater range of motion. Additionally, this new structure improves the flux line angles provided by the combined opposing fields. The majority of flux lines emanating from the radial magnet(s) maintain paths essentially perpendicular to the structure's axis. Therefore, the flux field linearity is nearly constant and substantially improved over prior art designs. Given the same design criteria as the prior art design discussed above, a structure constructed according to the invention and incorporating a single radial magnet can provide a 0.260–0.800 inch (6.6–20 mm) useful range of coil motion, and a design employing two radial magnets and an intervening spacer can provide a 0.410–1.50 inch (10.4–38.1 mm) useful range of coil motion.

Various combinations of radial and axial magnets can be placed together in a similar fashion to improve field linearity and flux density further.

Figure 2:
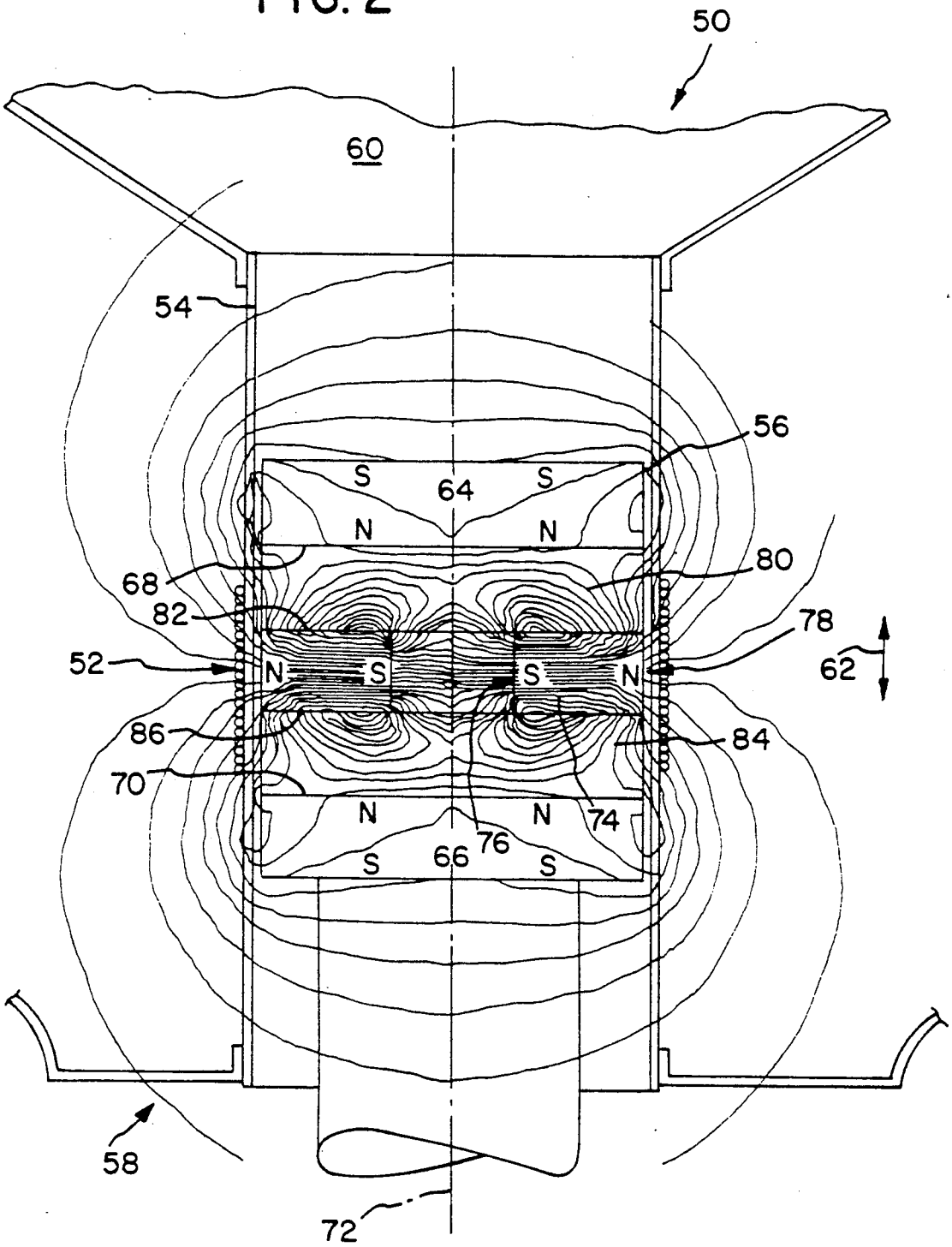
FIG. 2 illustrates a fragmentary axial sectional view through a first embodiment of a permanent magnet motor assembly constructed according to the present invention.

Referring now to FIG. 2, a permanent magnet motor assembly 50 is provided for reciprocating a current carrying solenoid conductor 52 such as a voice coil wound on a voice coil form 54. Conductor 52 is uniformly axially spaced from the outer surface 56 of assembly 50 by any of a number of well-known means, such as a centering spider 58 and a speaker diaphragm 60. Alternating current flow through the conductor 52 causes the voice coil form 54 and the regions of the spider 58 and diaphragm 60, both illustrated fragmentarily, which are coupled to voice coil form 54 to reciprocate in the directions of arrows 62, axially of motor assembly 50.

According to the invention, motor assembly 50 includes two permanent magnets 64, 66 having like poles 68, 70, respectively, facing each other along the axis 72 of the assembly 50. A radially magnetized permanent magnet 74 has a radially inner pole 76 of opposite polarity to poles 68, 70 and a radially outer pole 78 of the same polarity as poles 68, 70. This configuration shapes the magnetic field of assembly 50 as previously discussed to provide a more uniform radial magnetic field over a much greater percentage of the total length of assembly 50 than did prior art configurations. A spacer 80 is provided in assembly 50 between pole 68 and the axially facing surface 82 of magnet 74. A spacer 84 is provided between pole 70 and the axially facing surface 86 of magnet 74.

Illustratively, magnets 64, 66 and 74, spacers 80 and 84, and voice coil form 54 are all right circular cylindrical in configuration. However, other configurations clearly are possible, and may be preferred in certain applications.

Figure 3:
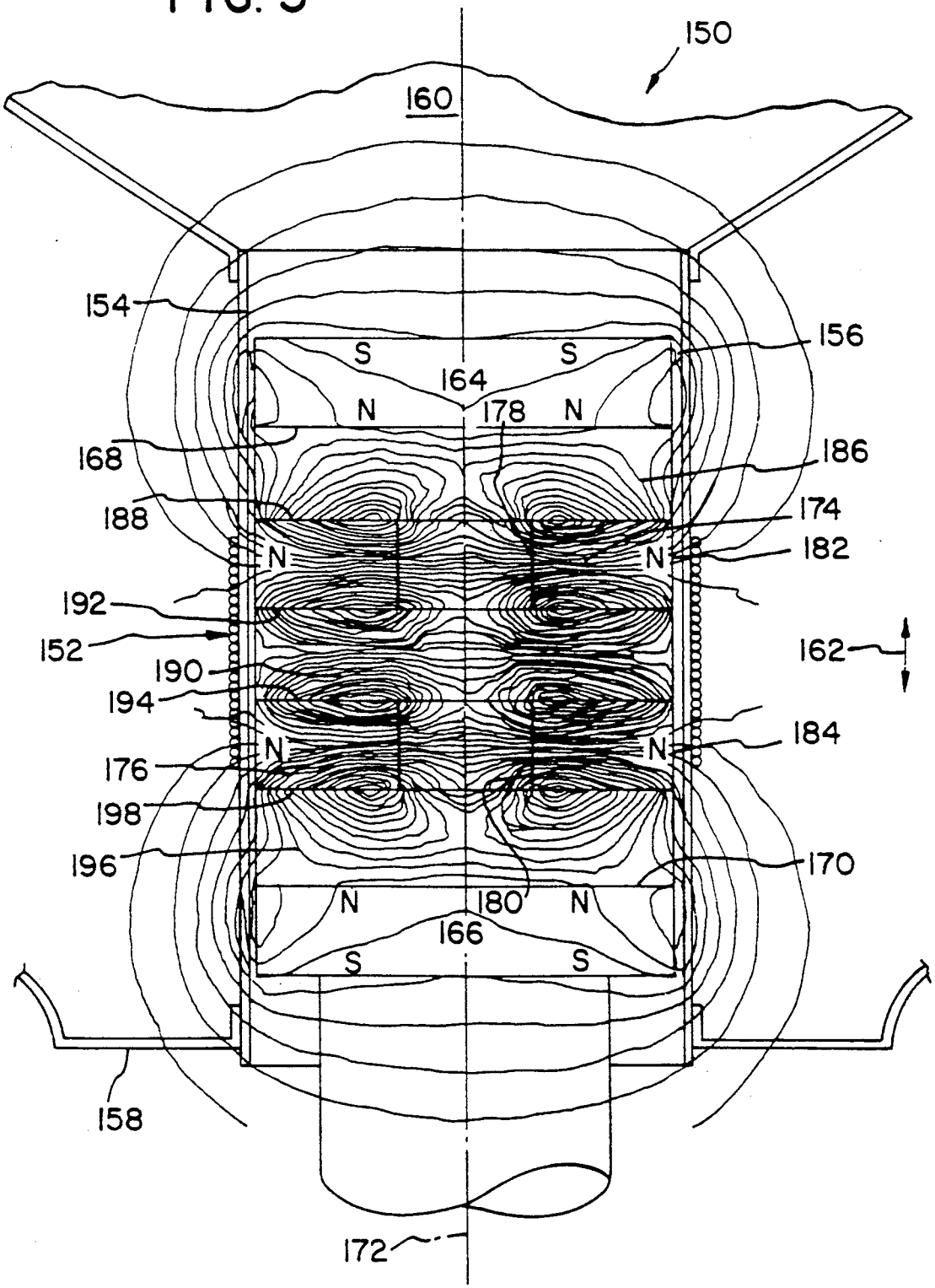
FIG. 3 illustrates a fragmentary axial sectional view through a second embodiment of a permanent magnet motor assembly constructed according to the present invention; and, FIG. 4 illustrates a fragmentary axial sectional view through a third embodiment of a permanent magnet motor assembly constructed according to the present invention.

Referring now to FIG. 3, another embodiment of a permanent magnet motor assembly 150 according to the present invention is provided for reciprocating a current carrying solenoid conductor 152, again such as a voice coil wound on a voice coil form 154. Conductor 152 is uniformly axially spaced from outer surface 156 of assembly 150 by any of a number of well-known means, such as a centering spider 158 and a speaker diaphragm 160, both illustrated fragmentarily. Alternating current flow through the conductor 152 causes the voice coil form 154 and the regions of the spider 158 and diaphragm 160 which are coupled to voice coil form 154 to reciprocate in the directions of arrows 162, axially of motor assembly 150.

According to this embodiment of the invention, motor assembly 150 includes two permanent magnets 164, 166 having like poles 168, 170, respectively, facing each other along the axis 172 of the assembly 150. Two radially magnetized permanent magnets 174, 176 have radially inner poles 178, 180, respectively, of opposite polarity to poles 168, 170. Permanent magnets 174, 176 have radially outer poles 182, 184 of the same polarity as poles 168, 170. This configuration shapes the magnetic field of assembly 150 as previously discussed to provide a more uniform radial magnetic field over a much greater percentage of the total length of assembly 150 than did prior art configurations. A spacer 186 is provided in assembly 150 between pole 168 and the axially facing surface 188 of magnet 174. A spacer 190 is provided between the axially facing surface 192 of magnet 174 and the axially facing surface 194 of magnet 176. A spacer 196 is provided between the axially facing surface 198 of magnet 176 and pole 170.

Again, illustratively, magnets 164, 166, 174 and 176, spacers 186, 190 and 196, and voice coil form 154 are all right circular cylindrical in configuration. However, as noted above, other configurations clearly are possible, and may be preferred in certain applications.

Figure 4:
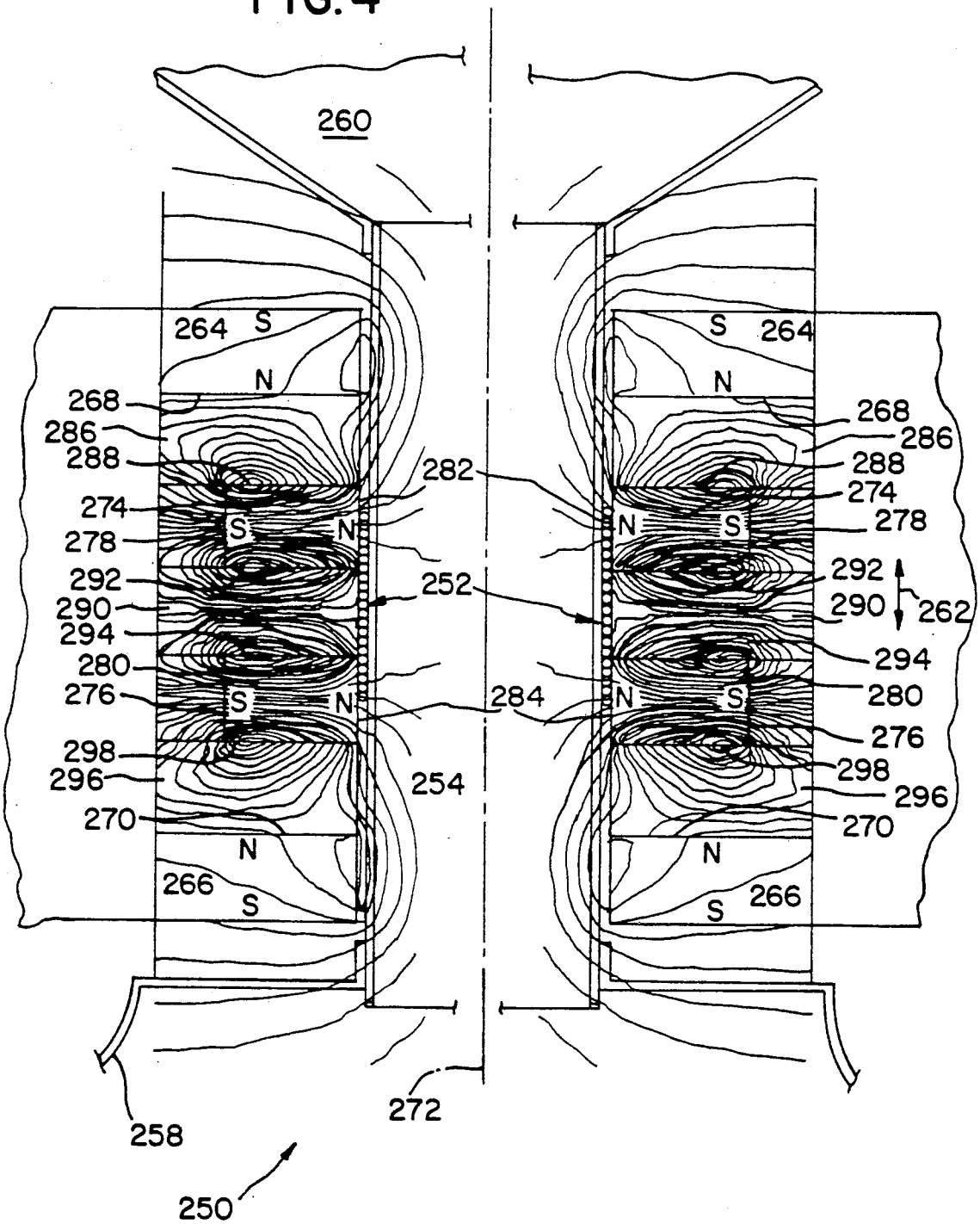

Referring now to FIG. 4, another permanent magnet motor assembly 250 according to the present invention is provided for reciprocating a current-carrying solenoid conductor 252, again such as a voice coil wound on a coil form 254. Conductor 252 is uniformly axially spaced from inner surface 256 of assembly 250 by any of a number of well-known means, such as a centering spider 258 and a speaker diaphragm 260. Alternating current flow through the conductor 252 causes the voice coil form 254 and the regions of the spider 258 and diaphragm 260 which are coupled to voice coil form 254 to reciprocate in the directions of arrows 262, axially of motor assembly 250.

According to this embodiment of the invention, motor assembly 250 includes two ring-shaped permanent magnets 264, 266 having like poles 268, 270, respectively, facing each other along the axis 272 of the assembly 250. Two radially magnetized, ring-shaped permanent magnets 274, 276 have radially outer poles 278, 280, respectively, of opposite polarity to poles 268, 270. Permanent magnets 274, 276 have radially inner poles 282, 284 of the same polarity as poles 268, 270. This configuration shapes the magnetic field of assembly 250 is previously discussed to provide a more uniform radial magnetic field over a much greater percentage of the total length of assembly 250 than did prior art configurations. A spacer 286 is provided in assembly 250 between pole 268 and the axially facing surface 288 of magnet 274. A spacer 290 is provided between the axially facing surface 292 of magnet 274 and the axially facing surface 294 of magnet 276. A spacer 296 is provided between the axially facing surface 298 of magnet 276 and pole 270.

Magnets 264, 266, 274 and 276, and spacers 286, 290 and 296 are all shaped as flat rings. Voice coil form 254 is right circular cylindrical in configuration. However, other configurations clearly are possible, and may be preferred in certain applications.

What is claimed is:

1. A returnless voice coil motor assembly comprising a voice coil, first and second magnets, the poles of the first and second magnets providing aligned, opposing lines of force in first and second opposite directions, a first spacer having a first face adjacent a pole of the first magnet and a second opposite face, a second spacer having a first face adjacent the like pole of the second magnet and a second opposite face, a third magnet oriented between the second faces of the first and second spacers, and means for mounting the voice coil in close proximity to the third magnet, the third magnet providing lines of force extending in a third direction generally transverse to both the first and second directions, and the voice coil having a direction of motion extending generally perpendicular to the third direction.

2. The apparatus of claim 1 wherein the first, second and third magnets are generally cylindrical in configuration.

3. The apparatus of claim 2 wherein the first, second and third magnets are generally right cylindrical in configuration.

4. The apparatus of claim 3 wherein the first, second and third magnets are generally right circular cylindrical in configuration, defining a transducer motor assembly axis about which each of the first, second and third magnets is generally symmetrical.

5. The apparatus of claim 1, 2, 3 or 4 wherein the means for mounting the voice coil in close proximity to the third magnet mounts the voice coil radially outward from the third magnet.

6. The apparatus of claim 1, 2, 3 or 4 wherein the means for mounting the voice coil in close proximity to the third magnet mounts the voice coil radially inward from the third magnet.

* * * * *